US007073582B2

(12) United States Patent
Connell et al.

(10) Patent No.: US 7,073,582 B2
(45) Date of Patent: Jul. 11, 2006

(54) METHOD AND APPARATUS FOR POSITIONING A DOWNHOLE TOOL

(75) Inventors: Michael L. Connell, Duncan, OK (US); Stephen E. Tilghman, Marlow, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 251 days.

(21) Appl. No.: 10/796,548

(22) Filed: Mar. 9, 2004

(65) Prior Publication Data

US 2005/0199392 A1 Sep. 15, 2005

(51) Int. Cl.
*E21B 47/00* (2006.01)

(52) U.S. Cl. ..... 166/254.2; 166/255.2; 166/113

(58) Field of Classification Search ..... 166/254.1, 166/253.1, 254.2, 255.1–255.2, 66
See application file for complete search history.

(56) References Cited

U.S. PATENT DOCUMENTS

| | | | | |
|---|---|---|---|---|
| 4,386,422 | A * | 5/1983 | Mumby et al. | 367/85 |
| 4,558,219 | A * | 12/1985 | LeBlanc et al. | 250/260 |
| 4,879,463 | A * | 11/1989 | Wraight et al. | 250/269.2 |
| 5,279,366 | A | 1/1994 | Scholes | |
| 5,469,916 | A | 11/1995 | Sas-Jaworsky et al. | |
| 5,586,084 | A | 12/1996 | Barron et al. | |
| 5,626,192 | A * | 5/1997 | Connell et al. | 166/255.1 |
| 6,119,777 | A | 9/2000 | Runia | |
| 6,253,842 | B1 | 7/2001 | Connell et al. | |
| 6,305,467 | B1 | 10/2001 | Connell et al. | |
| 6,370,082 | B1 | 4/2002 | Gardner et al. | |
| 6,421,298 | B1 | 7/2002 | Beattie et al. | |
| 6,431,270 | B1 | 8/2002 | Angle | 166/66.5 |
| 6,516,663 | B1 | 2/2003 | Wong | |
| 2002/0104653 | A1 | 8/2002 | Hosie et al. | 166/254.2 |
| 2003/0000300 | A1 | 1/2003 | Wong | 73/152.14 |

FOREIGN PATENT DOCUMENTS

WO 2 353 055 A 2/2001

OTHER PUBLICATIONS

Foreign Search Report and Opinion (PCT/GB2004/005318).

* cited by examiner

*Primary Examiner*—Frank S. Tsay
(74) *Attorney, Agent, or Firm*—John W. Wustenberg; McAfee & Taft

(57) ABSTRACT

A tool positioning assembly for positioning downhole tools at desired locations within a wellbore. The current invention further provides methods for using a tool positioning assembly. The tool positioning assembly and methods for using the same reduce the number of downhole trips required to perform downhole operations.

52 Claims, 4 Drawing Sheets

METHOD AND APPARATUS FOR POSITIONING A DOWNHOLE TOOL

BACKGROUND

The present invention relates to a downhole tool string assembly and method for positioning a downhole tool in a wellbore. More particularly, the present invention provides a tool positioning assembly capable of logging a well and determining locations within a wellbore as well as methods for using the same.

In the drilling and completion of oil and gas wells, a wellbore is drilled into the subterranean producing formation or zone of interest. Well completion may take one of several forms. One common completion method places and cements a casing in the wellbore. Following perforation of the casing, fluid is produced from the well through production tubing positioned within the casing. These subterranean strings of pipe are each comprised of a plurality of pipe sections joined together. The pipe joints, also often referred to as pipe collars or casing collars, can be detected because they produce an anomaly in a magnetic field as compared to other portions of the pipe string.

For the downhole tool to perform its planned function it must be positioned in the well at the proper depth. Following positioning, the downhole tool is activated by one of several methods, depending on the downhole tool. Methods of activation include but are not limited to tubing movement, tool movement, application of pressure, application of flow, dropping of balls on sleeves, pressure changes due to changes in flow rate, electronic means, or combinations of the above.

Knowledge of the precise location of casing collars and downhole formations is necessary when positioning downhole tools such as packers or perforating guns within the wellbore. Typically downhole tools are lowered into the well on a length of coiled tubing. The depth of a particular casing collar adjacent to or near the zone of interest to which the tool is positioned is generally determined on the basis of a previously recorded casing joint or collar profile for the well. That is, after open hole logs have been run in a drilled wellbore and one or more pipe strings have been cemented therein, an additional log is typically run within the pipe strings. The additional log is a depth reference log that establishes the position of casing collars to the previous open hole logs and respective zones of interest. This log typically becomes the working depth reference log for the well. Logging processes of this type are well known to those skilled in the art.

Given this readily available depth reference log, it would seem to be a straightforward task to lower a downhole tool to a desired location within any particular downhole zone of interest. In theory, a conventional surface based measuring device monitors the injection of the coiled tubing carrying the downhole tool and reports the arrival of the tool at the desired depth. However, regardless of the accuracy of the coiled tubing surface measuring device, true depth measurement is inherently flawed due to initial inaccuracies in the depth reference log, coiled tubing stretch, elongation from thermal effects, sinusoidal and helical buckling, and a variety of often unpredictable deformations in the length of coiled tubing suspended in the wellbore.

Attempts have been made to accurately control the depth of downhole tools connected to coiled tubing. One current method uses a production tubing end locator attached to coiled tubing. The production tubing end locator tool usually consists of collets or heavy bow springs that spring outwardly when the tool is lowered beyond the end of the production tubing string. Raising the coiled tubing pulls the tool back into the production tubing string thereby generating a drag force detectable by a weight indicator at the surface.

The use of such production tubing string end locator tools involves a number of problems. The most common problem is that not all wells include production tubing strings and only have casing or are produced open hole. Wells of this type lack a production tubing string on which the tool can catch when moved upward. Another problem associated with referencing the lower end of the production tubing string as a locator point results from the non-alignment of the tubing end with the zone of interest. Tubing section lengths are tallied as they are run in the well and mathematical or length measurement errors are common. Even when the tubing sections are measured and tallied accurately, the joint and tally log may not accurately locate the end of the tubing string with respect to the zone of interest. Yet another problem in the use of production tubing in locator tools is that a different sized tool must be used for different sizes of tubing. Further, in deviated or deep wells, the small weight increase as a result of the drag produced by the end locator tool is not enough to be noticeable at the surface.

While a variety of other types of casing collar locators have been developed including slick line indicators that produce a drag inside the tubing string, wireline indicators that send an electronic signal to the surface by way of electric cable and others, they either cannot be used as a component in a coiled tubing downhole tool system or have disadvantages when so used. The current invention overcomes the problems of the prior art by providing a novel tool positioning assembly and method for using the same. The novel downhole tool positioning assembly comprises a gamma ray detection assembly and optionally comprises a casing collar locator. Use of the novel tool positioning assembly reduces the necessity of multiple downhole trips to place other tools at desired downhole locations.

SUMMARY

The current invention provides a tool positioning assembly for positioning a downhole tool connected to a tool string. The tool positioning assembly comprises a housing having upper and lower ends adapted for connection to the tool string. The housing has a fluid passageway for providing fluid communication therethrough. A communication unit and a radiation detection unit for measuring radiation in the downhole environment and for generating a signal corresponding to the measured radiation are positioned within the housing. Also positioned within the housing is a control unit for receiving signal from the radiation detection unit and for controlling the communication unit. Finally, a power source suitable for providing power to the radiation detection unit, the control unit and the communication unit is also located within the housing.

In another embodiment, the current invention provides a tool positioning assembly for positioning a downhole tool connected to a tool string. Carried by coiled tubing, the tool positioning assembly comprises a housing having upper and lower ends adapted for connection to the tool string. The housing has a fluid passageway for providing fluid communication therethrough. Positioned within the housing are a casing collar locator, a radiation detection unit positioned for measuring radiation in the downhole environment and for generating a signal corresponding to the measured radiation, a communication unit and a control unit. The control unit receives signals from the casing collar locator and the radiation detection unit and directs the operation of the communication unit. Additionally, within the fluid passageway is a pressure isolation means for preventing fluid communication between the coiled tubing and a downhole tool incorporated into the tool string. Finally, a power source for providing power to the casing collar locator, the radiation detection unit, the control unit and the communication unit is positioned within the housing.

The current invention also provides a method for accurately positioning a downhole tool within a wellbore. According to the method of the current invention, a wellbore is drilled through at least one subterranean zone of interest and wellbore log prepared during or subsequent to drilling of the wellbore. Thereafter, a tool string is attached to tubing, the tool string comprises a tool positioning assembly and the downhole tool. The tubing and tool string are moved through the wellbore. As the tool string moves through the wellbore, the tool positioning assembly determines the concentration of radiation emissions within the wellbore. The location of the downhole tool is determined by correlating the relative strength of the radiation emissions to the wellbore log. The downhole tool is then positioned at the desired location by raising or lowering the tubing.

In yet another embodiment, the current invention provides a method for accurately positioning and activating a downhole tool within a wellbore. According to the method of the current invention, a wellbore is drilled through at least one subterranean zone of interest and wellbore log prepared during or subsequent to drilling of the wellbore. Thereafter, a tool string is attached to coiled tubing. The tool string comprises a tool positioning assembly and the downhole tool. The coiled tubing and tool string are injected into the wellbore to a depth below the zone of interest. The coiled tubing and tool string are then moved through the wellbore while determining the concentration of radiation emissions within the wellbore. Data corresponding to the relative strength of the radiation is transmitted to the surface and the location of the downhole tool is determined by correlating the relative strength of the radiation emissions to the wellbore log. The downhole tool is then positioned at the desired location by raising or lowering the coiled tubing. Once the tool is positioned at the desired location it is activated.

Still further, the current invention provides a method for accurately positioning and activating a downhole tool within a wellbore. According to the method of the current invention, a wellbore is drilled through at least one subterranean zone of interest and wellbore log prepared during or subsequent to drilling of the wellbore. Thereafter, a tool string is attached to tubing. The tool string comprises a tool positioning assembly and the downhole tool. A fluid pressure sensor is provided for detecting changes in fluid pressure within the tubing. The tubing and tool string are lowered into the wellbore. The tubing and tool string are then moved through the wellbore while determining the concentration of radiation emissions within the wellbore. As the tubing and tool string move through the wellbore, fluid flows through the tubing and tool string. Fluid pressure is continuously monitored by the fluid pressure sensor. Data corresponding to the relative strength of the radiation is transmitted to the fluid pressure sensor by varying the fluid pressure of the flowing fluid. The location of the downhole tool is determined by correlating the relative strength of the radiation emissions to the wellbore log. The downhole tool is then positioned at the desired location by raising or lowering the tubing. Following positioning at the desired location, the tool is activated.

Additionally, the current invention provides a method for accurately positioning and activating a downhole tool within a wellbore. According to the method of the current invention, a wellbore is drilled through at least one subterranean zone of interest and wellbore log prepared during or subsequent to drilling of the wellbore. Thereafter, a tool string is attached to coiled tubing. The tool string comprises a tool positioning assembly and the downhole tool. The tool positioning assembly comprises a housing having upper and lower ends adapted for connection to the tool string. The housing has a fluid passageway for providing fluid communication therethrough. Positioned within the housing is a casing collar locator, a radiation detection unit positioned for measuring radiation in the downhole environment and for generating a signal corresponding to the measured radiation, a mud pulser communication unit and a control unit. The control unit receives signals from the casing collar locator and the radiation detection unit and directs the operation of the communication unit. Additionally, the housing includes within the fluid passageway a pressure isolation means for preventing fluid communication between the coiled tubing and a downhole tool incorporated into the tool string. Additionally, the tool positioning assembly has a power source for providing power to the casing collar locator, the radiation detection unit, the control unit and the communication unit is positioned within the housing. The coiled tubing and tool string are lowered into the wellbore. The coiled tubing and tool string are then moved through the wellbore while determining the concentration of radiation emissions within the wellbore. Data corresponding to the relative strength of the radiation is transmitted to the surface. The location of the downhole tool is determined by correlating the relative strength of the radiation emissions to the wellbore log. The coiled tubing and tool string is then lowered to a point lower than the desired point for activating the downhole tool. The coiled tubing and tool string is then raised while continuing to monitor radiation emissions until the relative strength of radiation detected by the radiation detection unit reflects the desired depth for activating the tool. Upon reaching the desired depth, the tool is activated at the operator's convenience.

DETAILED DESCRIPTION

After a well has been drilled, it is often necessary to service the well whereby procedures are performed therein such as perforating, setting plugs, setting cement retainers, spotting permanent packers and the like. Coiled tubing is often used to carry out these procedures. Coiled tubing, relatively small flexible tubing, e.g., 1 to 3.5 inches in diameter, is normally stored on a reel when not in use. When used for performing well procedures, the tubing is passed through an injector mechanism and a tool string is connected to the end thereof. The tool string may comprise one or more tools joined together by any convenient means known to those skilled in the art. The injector mechanism pulls the tubing from the reel, straightens the tubing and injects it through a seal assembly at the wellhead known as a "stuffing box." Typically, the injector mechanism injects thousands of feet of the coiled tubing with the tool string connected at the bottom end thereof into the casing string or the production tubing string of the well. A fluid, most often a liquid such as salt water, brine, mud or a hydrocarbon liquid, is circulated through the coiled tubing for operating the downhole tool(s) or for other purposes. The coiled tubing injector at the surface is used to raise and lower the coiled tubing and the tool string during the service procedure and to remove the coiled tubing and tool string as the tubing is rewound on the reel at the end of the procedure.

Because coiled tubing is most often used for these procedures, the following disclosure of the current invention will be described in conjunction with coiled tubing. However, the apparatus and methods of the current invention are equally suitable for use with other oil field tubing or pipe.

Figure 1:
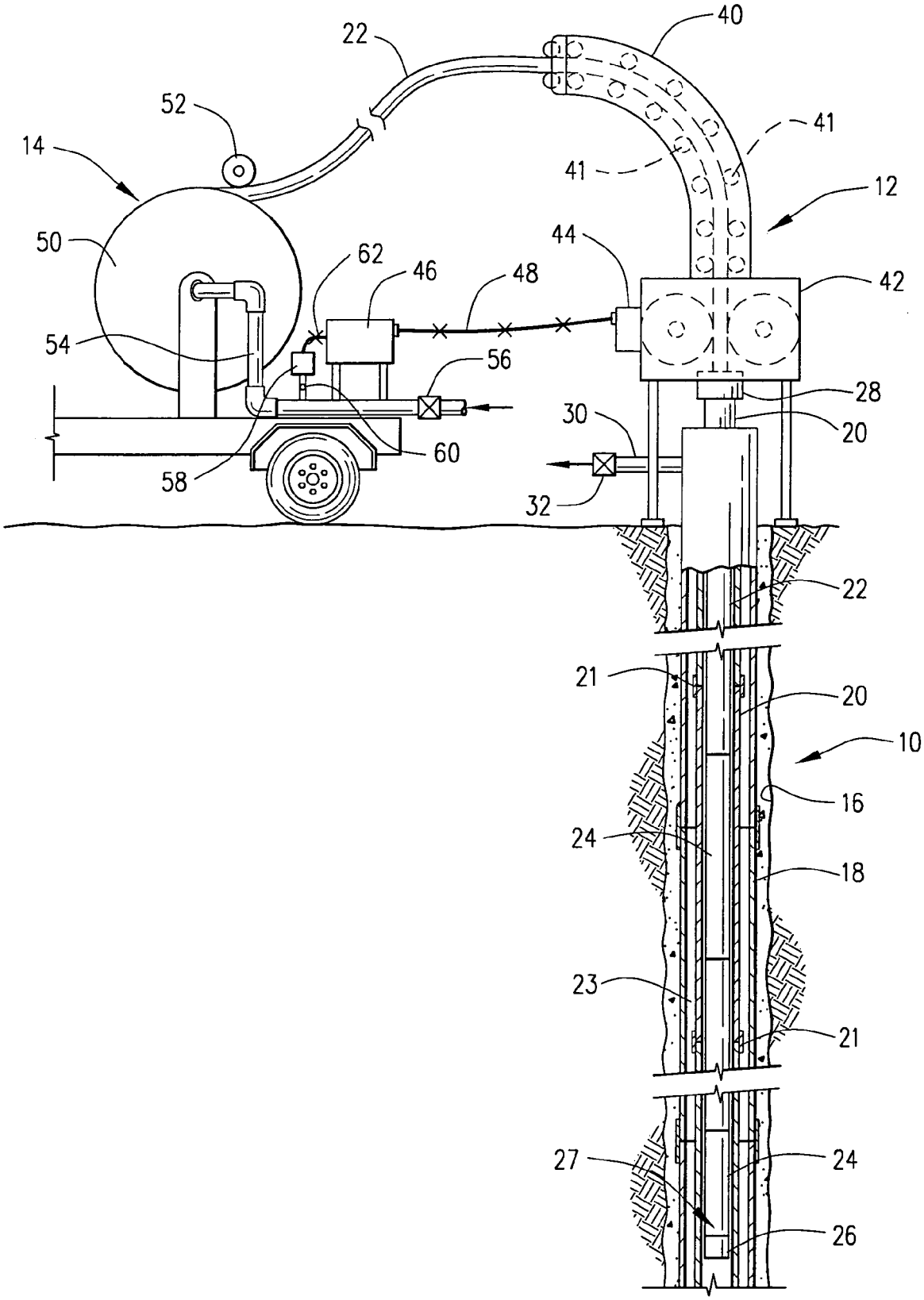
FIG. 1 is a schematic illustration of a cased well having a string of production tubing disposed therein and having a length of coiled tubing with the tool positioning assembly of the present invention connected thereto inserted therein by way of a coiled tubing injector and truck mounted reel.

Referring now to FIG. 1, a well 10 is schematically illustrated along with a coiled tubing injector 12 and a truck mounted coiled tubing reel assembly 14. The well 10 includes a wellbore 16 having a string of casing 18 cemented therein in the usual manner. A string of production tubing 20 is also installed in the well 10 within the casing string 18. A length of coiled tubing 22 is inserted in the tubing string 20 having a tool positioning assembly 24 of the present invention connected at the bottom end thereof and a downhole tool 26 connected to the bottom end of the tool positioning assembly 24. Tool positioning assembly 24 and downhole tool 26 comprises a tool string 27. The arrangement of downhole tool 26 above or below tool positioning assembly 24 may vary from operation to operation as required for the unique characteristics of each well 10.

For the purposes of this disclosure, the tool string 27 comprises at least one downhole tool 26 and tool positioning assembly 24. Tool string 27 may comprise additional downhole tools as necessary for the particular operation. The actual arrangement of the downhole tools in tool string 27 is not critical to the current invention. As such, tool positioning assembly 24 may be connected directly to coiled tubing 22 or may be arranged as an intermediate or terminal part of tool string 27. Further, other downhole tools 26 may be incorporated above or below tool positioning assembly 24.

Coiled tubing 22 is inserted into the well 10 by way of a stuffing box 28 attached to the upper end of tubing string 20. Stuffing box 28 functions to provide a seal between coiled tubing 22 and production tubing 20 whereby pressurized fluids within the well are prevented from escaping to the atmosphere. A circulating fluid removal conduit 30 having a shut-off valve 32 therein is sealingly connected to the top of the casing string 18. The fluid circulated into the well 10 by way of the coiled tubing 22 is removed from the well by way of the conduit 30 and valve 32 from where it is routed to a pit, tank or other fluid accumulator (not shown).

The coiled tubing injector mechanism 12 is of a design known to those skilled in the art. Coiled tubing injector 12 straightens the coiled tubing and injects it into well 10 by way of stuffing box 28. Coiled tubing injector 12 comprises a straightening mechanism 40 having a plurality of internal guide rollers 41 therein and a coiled tubing drive mechanism 42 for inserting the coiled tubing into the well, raising it or lowering it within the well and removing it from the well as it is rewound on a reel 50 of the assembly 14. A depth measuring device 44 is connected to the coiled tubing drive mechanism 42. Measuring device 44 continuously measures the length of coiled tubing 22 injected into the well 10 and provides that information by way of an electric transducer (not shown) and an electric cable 48 to an electronic data acquisition system 46.

The truck mounted reel assembly 14 includes reel 50 for containing coils of the coiled tubing 22. A guide wheel 52 for guiding the coiled tubing 22 on and off reel 50 is provided and a conduit assembly 54 is connected to the end of coiled tubing 22 on reel 50 by way of a swivel system (not shown). A shut-off valve 56 is disposed in conduit assembly 54 and conduit assembly 54 is connected to a fluid pump (not shown) which pumps the fluid to be circulated from a pit, tank or other fluid accumulator through conduit assembly 54 and into coiled tubing 22. A fluid pressure sensor 58 or equivalent device is connected to conduit assembly 54 by way of a connection 60 attached thereto and to data acquisition system 46 by an electric cable 62. As will be understood by those skilled in the art, data acquisition system 46 functions to continuously record the depth of coiled tubing 22 and tool positioning assembly 24 attached thereto in well 10 and the surface pressure of the fluid being pumped through coiled tubing 22 and tool positioning assembly 24.

Figure 2A:
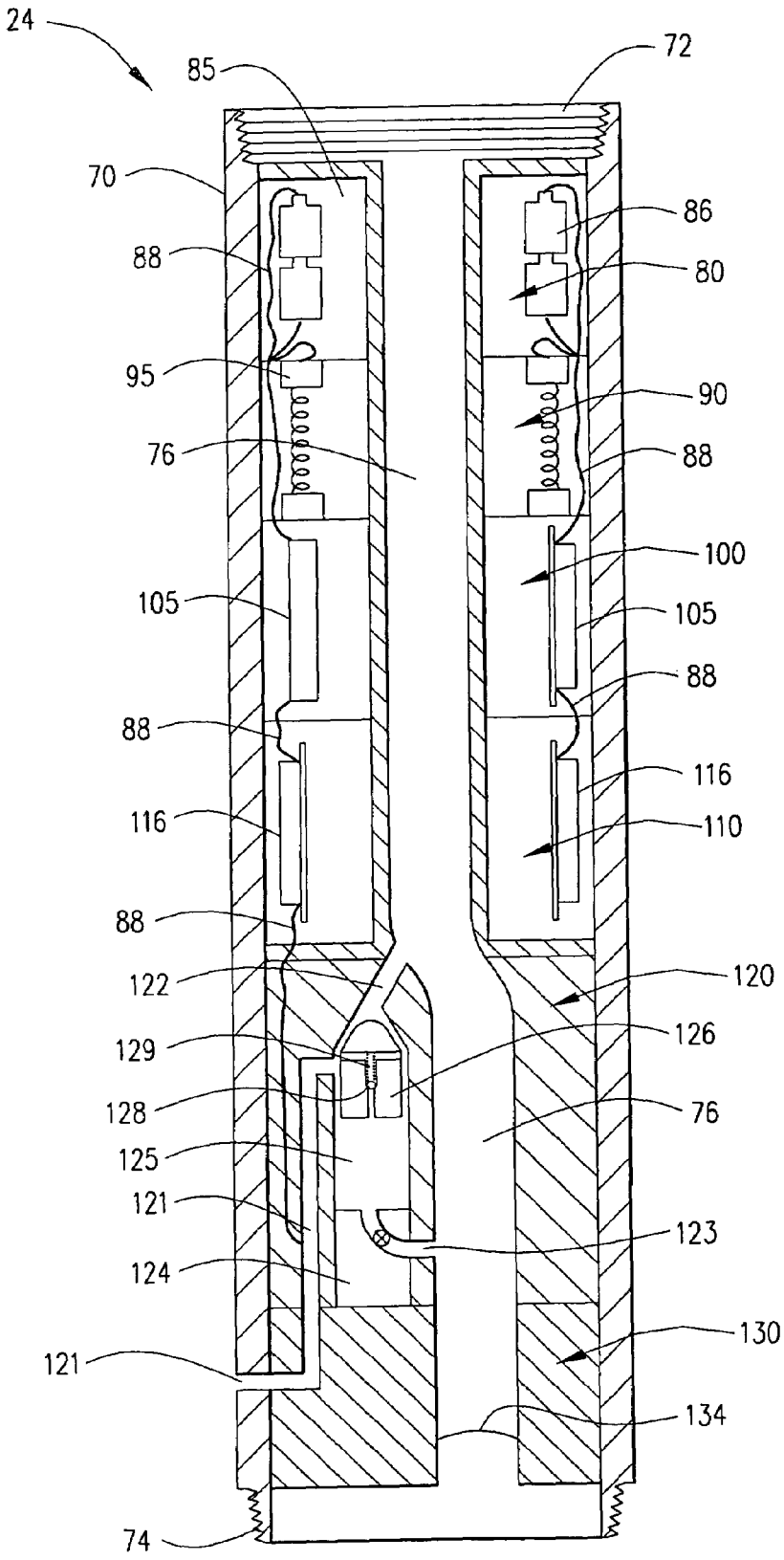
FIGS. 2*a* and 2*b* are side cross-sectional views of the tool positioning assembly of the present invention.
Figure 2B:
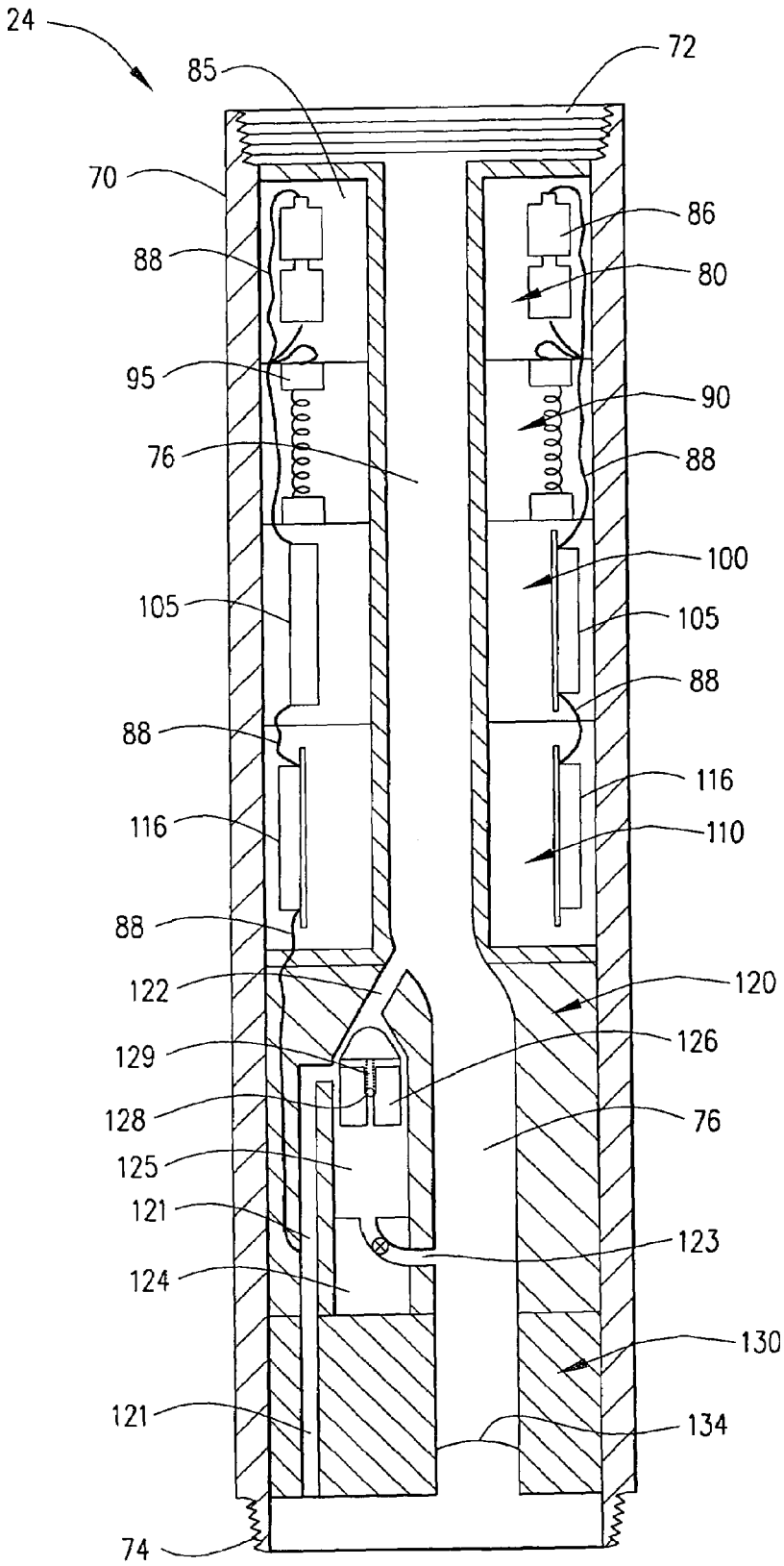

Referring now to FIGS. 2*a* and 2*b*, tool positioning assembly 24 of the present invention is illustrated in detail. Tool positioning assembly 24 includes an elongated cylindrical housing 70 having an internally threaded box connection 72 at the upper end for connecting the housing 70 to a complimentary connection of a coupling (not shown) attached to the end of coiled tubing 22 or another part of tool string 27. An externally threaded box connection 74 is provided at the bottom end of housing 70 for connecting tool positioning assembly 24 to downhole tool 26 to be activated when properly positioned. Housing 70 is hollow and includes a fluid passageway 76 extending through its length. Passages 121 and 122 extend through housing 70 to provide fluid communication between passage 76 and the exterior of housing 70. Mechanical unit 130 provides fluid communication between communication unit 120 and either annulus 23 or downhole tool 26 through passage 121. If downhole tool 26 is sensitive to fluid pressure or fluid flow, then mechanical unit will direct fluid flow through passageway 121 to annulus 23 as shown in FIG. 2*a*. However, if downhole tool 26 is not sensitive to fluid flow or pressure then passageway 121 can direct fluid through downhole tool 26 as shown in FIG. 2*b*. Other arrangements of passageways 121 and 122 will be apparent to those skilled in the art.

The electronic components of tool positioning assembly 24 are disposed within housing 70 without blocking passageway 76. For ease of construction, the electrical components of tool positioning assembly 24 are preferably prepared as separate units or sub-assemblies and fitted within housing 70. In one embodiment, tool positioning assembly 24 comprises a power unit 80, a casing collar locator unit 90, a radiation detector unit 100, a control unit 110, a communication unit 120 and a mechanical unit 130. Preferably, these units have a generally annular configuration thereby leaving passageway 76 unobstructed.

In general each unit has sufficient area to house the necessary electrical components for the given purpose of the unit. In unit 80, annular space 85 will house a power source 86 such as a generator (not shown) or conventional batteries 86. Power source 86 may be any conventional device, known to those skilled in the art, capable of generating sufficient electricity to power the other sub-assemblies.

Power source 86 is connected by conventional wires and contacts generally designated by the numeral 88 to each unit requiring power.

While power unit 80, casing collar locator unit 90, radiation detector unit 100, control unit 110, communication unit 120 and mechanical unit 130 have been described as individual units positioned within housing 70, each unit can be in the form of a sub-assembly which may be joined one to another in order to form downhole tool positioning assembly 24 and housing 70. In this embodiment, the sub-assemblies have an annular configuration with each sub-assembly having an opening 76 which forms fluid passageway 76 when the sub-assemblies are joined together as tool positioning assembly 24. Additionally, the current invention contemplates the combination of separate units. For example, control unit 110 and power unit may optionally be combined together as a single unit or sub-assembly prior to incorporation in downhole tool positioning assembly 24.

As will be described in greater detail below, casing collar locator unit 90 and radiation detector unit 100 transmit data to control unit 110. Subsequently, control unit 110 generates a signal directing the communication unit 120 to alter fluid pressure within coiled tubing 22. Accordingly, control unit 110 houses electric circuit boards and other components 116. The electric circuit boards and other components 116 may include central processors and other similar computer equipment capable of receiving and interpreting data as known to those skilled in the art. Components 116 are electrically connected to each unit by conventional wires and contacts 88. In one embodiment, control unit 110 is provided with sufficient memory to permit storage of data for a period of time. Thus, data stored in control unit 110 may be transmitted subsequent to the logging operations or the data may be downloaded at the surface following retrieval of tool positioning assembly 24.

Communication unit 120 provides the means for transmitting a pressure pulse detectable by pressure sensor 58. Communication unit 120 comprises passageway 76, a preferably electromagnetic valve 124, a fluid chamber 125, a poppet valve 126, having a pressure by-pass valve 128 and spring 129, and passageways 121, 122 and 123. U.S. Pat. No. 5,586,084, incorporated herein by reference describes a mud pulser which may be readily adapted for use within communication unit 120. Alternative pressure pulse generation devices suitable for transmitting signals in the method and assembly of the current invention are well known to those skilled in the art.

Communication unit 120 generates pressure pulses by movement of electromagnetic valve 124. When electromagnetic valve 124 is closed poppet valve 126 is in the open position and passageways 121 and 122 provide fluid communication between passageway 76 and the exterior of tool positioning assembly 24. When electromagnetic valve 124 is in the open position, passageway 123 provides fluid communication between fluid chamber 125 and passageway 76 closing poppet valve 126. Thus, opening of electromagnetic valve 124 will create a pressure pulse within coiled tubing 22. Finally, when the electromagnet valve closes pressure by-pass valve 128 provides fluid communication between fluid chamber 125 and passageway 121 allowing poppet valve 126 to open.

Mechanical section 130 provides the means for joining other downhole tools to tool positioning assembly 24. In one embodiment, the means for joining downhole tools to tool positioning assembly 24 is in the form of a threaded external box connection 74. Additionally, during logging operations passageway 76 is preferably blocked by a rupture disk 134 preferably located within mechanical section 130. Rupture disk 134 prevents communication of fluid pressure to downhole tool 26. Thus, rupture disk 134 isolates other downhole tools from fluid pressure within passageway 76. Use of rupture disks and other similar devices are well known to those skilled in the art as demonstrated by U.S. Pat. No. 6,305,467 incorporated herein by reference.

Casing collar locator unit 90, houses an electromagnetic coil assembly 95. As the coiled tubing 22 is raised or lowered in the well 10 and tool positioning assembly 24 passes through a casing collar 21 of the production tubing string 20, the electromagnetic coil assembly 95 electromagnetically senses the magnetic anomaly of casing collar 21. The electronic circuit boards and other components generate a momentary electric output signal which is received by control unit 110.

In one embodiment, control unit 110 interprets the electric signal received from casing collar locator unit 90 and in real time directs communication unit 120 to alter fluid pressure by operation of electromagnetic valve 124 in a predetermined pattern. The opening of electromagnetic valve 124 permits fluid communication between fluid chamber 125 and passageway 76. The fluid pressure within fluid chamber 125 moves poppet valve 126 upwards blocking at least the majority of fluid passing through passageway 122. The blockage of fluid flowing through passageway 122 produces a pressure pulse within passageway 76 and coiled tubing 22. The coordinated opening and closing of electromagnetic valve 124 produces a series of pressure pulses detectable by pressure sensor 58. Data acquisition system 46 interprets the pressure pulses and provides the means for correlating the earlier well log to the data provided by tool positioning assembly 24 thereby providing the means for accurately positioning downhole tools.

Radiation detector unit 100 houses a conventional radiation detector 105 and wiring and contacts 88 necessary to join radiation detector unit to control unit 110 and power unit 80. The preferred radiation detector is a gamma ray detector or a neutron detector. Most preferred is a gamma ray detector. Preferably, radiation detector 105 can be turned on and off in response to signals received from control unit 110. Following activation, radiation detector 105 measures radiation in the borehole and transmits the resulting data to the control unit 110. Control unit 110 in turn directs the communication unit 120 to generate detectible changes in fluid pressure in the manner described above.

Units 80, 90, 100, 110, 120 and 130 are assembled within housing 70 by conventional means known to those skilled in the art. Conventional electric wires and contacts 88 connect communication unit 120 and the previously described electronic components in the other sub-assemblies.

Figure 3:
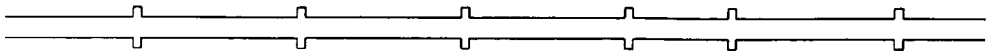
FIG. 3*a* is a theoretical well log.
FIG. 3*b* is a theoretic correlation log and FIG. 3*c* is a theoretical casing collar profile.
Figure 3B:
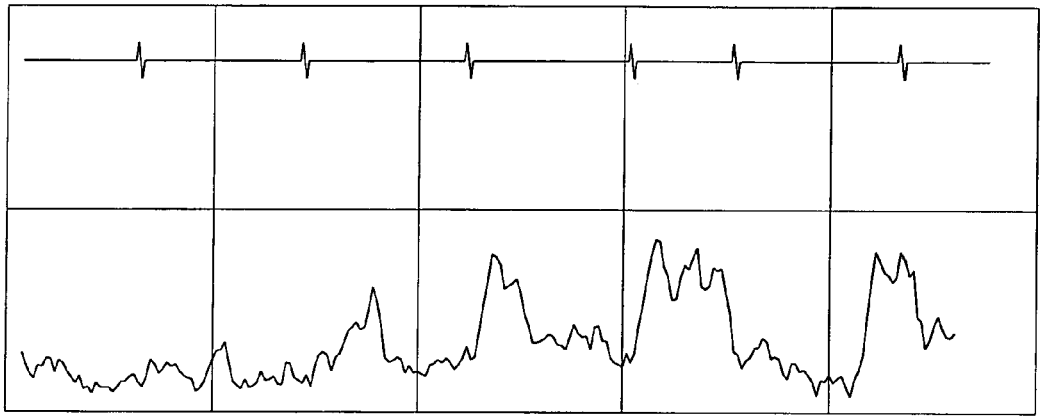
Figure 3C:
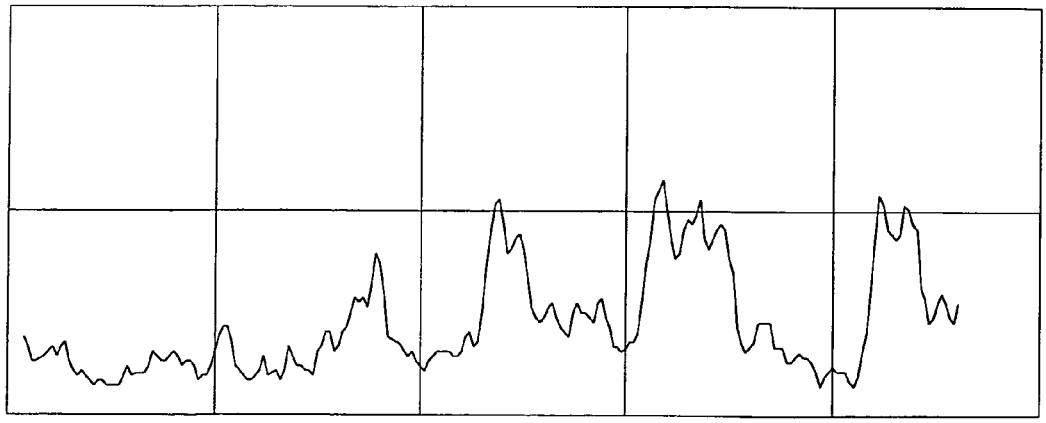

The methods of the current invention for accurately positioning and operating a downhole tool will be described with continued reference to the drawings. The methods of the current invention are applicable in both cased and uncased wells using or omitting production tubing. Conventional methods of drilling and completing the well are suitable for use in the current invention. The methods of the current invention use an initial well log generated during or after drilling wellbore 16. An initial well log normally measures formation characteristics such as but not limited to resistivity, neutron radiation, acoustics and spontaneous potential as known to those skilled in the art. Although not a requirement, the initial well log preferably includes a gamma ray radiation log of the well. FIG. 3*a* depicts a theoretical initial gamma ray well log and FIG. 3*c* depicts a theoretical casing collar profile. As known to those skilled in the art, casing collar logs or profiles are normally created by wireline logging following the process of casing the wellbore. The profile represents the position of collars with reference to the gamma ray log from the original wellbore log.

Following completion of wellbore 16, the coiled tubing apparatus described above is positioned at well 10. A tool string 27 comprising tool positioning assembly 24 and downhole tool 26 is attached to coiled tubing 22 and injected downhole. As depicted in FIG. 1, tool positioning assembly 24 and coiled tubing 22 are injected downhole through stuffing box 28 and production tubing 20. Normally, fluid will be flowed through coiled tubing 22 and tool positioning assembly 24 during the injection process.

In one embodiment, coiled tubing 22 and tool positioning assembly 24 are lowered to a point within wellbore 16 lower than the desired location for operating downhole tool 26. In this embodiment, control unit 110 is preferably in a dormant state during the injection process. The period of dormancy can be controlled by any conventional means. Typically, control unit 110 will include either a timer (not shown) set for a period of time estimated to be greater than the time necessary for injecting coiled tubing 22, a pressure sensor (not shown) set to activate control unit 110 upon reaching a predetermined pressure, a flow activation sensor or any other means suitable for activating control unit 110 known to those skilled in the art. Regardless of the activation means, control unit 110 preferably activates automatically and tool positioning assembly 24 is ready for use.

Following activation of control unit 110, radiation detector 105, casing collar locator 90 and communication subassemblies are brought on-line. With tool positioning assembly 24 ready to take downhole measurements, coiled tubing 22 is preferably moved upwards while radiation detector 105 and casing collar locator 90 log the well. However, certain conditions may necessitate lowering tool positioning assembly 24 while logging the well. Radiation detector 105 and casing collar locator 90 transmit logged data to control unit 110, which in turn directs communication unit 120 to open and close valves 124 and 126. The movement of valves 124 and 126 creates pressure changes within the fluid flowing through coiled tubing 22. These pressure changes are sufficient to be detected by fluid pressure sensor 58. Preferably, pressure sensor 58 is located at the surface; however, the current invention does not preclude the positioning of the pressure sensor 58 at other locations.

In one embodiment of the current invention, tool positioning assembly 24 will then be raised to a point above the desired location for activating downhole tool 26. Subsequently, the method continues to log the well and compare the resulting data to the earlier log while lowering tool positioning assembly 24 to a point below the zone of interest. The desired location for activating downhole tool 26 is accurately determined by once again raising tool positioning assembly 24 until the transmitted data indicates positioning of tool positioning assembly 24 and downhole tool 26 at the desired location. Thereafter, downhole tool 26 is activated.

To accurately determine the location of tool positioning assembly 24 and downhole tool 26 within the zone of interest, the method of the current invention compares or correlates the data obtained by tool positioning assembly 24 to the initial wellbore log. As depicted in FIG. 3*b*, a gamma ray correlation log obtained during the method of the current invention typically has a lower magnitude than an initial gamma ray wellbore log. The lower magnitude results from the partial shielding provided by the casing 18. FIG. 3*b* represents a theoretical correlation log depicting both casing collar data and gamma ray data.

Preferably, the correlation log is prepared by comparing an initial gamma ray log to a correlation gamma ray log generated by tool positioning assembly 24. However, the correlation gamma ray log generated by tool positioning assembly 24 can be compared to any prior wellbore log such as but not limited to neutron radiation logs, acoustic logs, spontaneous potential logs, resistivity logs and other formation characteristic logs that may be developed by those skilled in the art. In general, generation of a correlation log does not require direct comparison of peaks. Rather, the correlation log provides depth correlation by comparing differences in downhole formations.

In one embodiment, downhole tool 26 is activated by an increase in fluid pressure. Thus, when tool positioning assembly 24 carries a rupture disk 134, the operator will increase fluid pressure within passageway 76 sufficiently to break rupture disk 134. The resulting fluid pressure within tool 26 will then activate tool 26.

In one embodiment, electric data acquisition system 46 constantly receives real time data from depth measuring device 44 and fluid pressure sensing device 58. Electric data acquisition system 46 utilizes this data to generate a correlation well log. The correlation well log includes radiation emission data and optionally includes casing collar data. However, as noted above, an alternate preferred embodiment provides for the delayed transmission of data by storing the data in control unit 110 to be transmitted or downloaded at a later time.

In an alternative embodiment of the method of the current invention, the current invention begins logging the well immediately upon injection of coiled tubing 22 and tool positioning assembly 24 into well 10. Data concerning casing collars and radiation emissions is transmitted to electric data acquisition system 46 in the manner described above and correlated to the earlier wellbore log. Coiled tubing 22 and tool positioning assembly 24, which carries tool 26, are injected to a position lower than the desired tool activation point. Subsequently with continued well logging, coiled tubing 22, tool positioning assembly 24 and downhole tool 26 are raised until the correlated data indicates that tool positioning assembly 24 and downhole tool 26 are at the desired location. Thereafter, downhole tool 26 is activated in the manner described above.

Other embodiments of the current invention will be apparent to those skilled in the art from a consideration of this specification or practice of the invention disclosed herein. However, the foregoing specification is considered merely exemplary of the current invention with the true scope and spirit of the invention being indicated by the following claims.

What is claimed is:

1. A downhole tool positioning assembly comprising:

a housing having upper and lower ends adapted for connection to a tool string;

a fluid passageway for providing fluid communication through the housing;

a radiation detection unit positioned within the housing for measuring radiation in the downhole environment and for generating a signal corresponding to the measured radiation;

a communication unit positioned within the housing;

a control unit positioned within the housing for receiving signals from the radiation detection unit and for controlling the communication unit; and a power source for providing power to the radiation detection unit, the control unit and the communication unit.

2. The tool positioning assembly of claim 1, further comprising a casing collar locator positioned within the housing.

3. The tool positioning assembly of claim 2, wherein the casing collar locator comprises:

an electromagnetic coil and magnet for electromagnetically sensing a casing collar; and an electric circuit for generating a signal when said coil electromagnetically senses a casing collar.

4. The tool positioning assembly of claim 2, wherein said control unit positioned within the housing receives signals from the casing collar locator for controlling the communication unit.

5. The tool positioning assembly of claim 1, wherein the radiation detection unit comprises a gamma ray detector or a neutron detector.

6. The tool positioning assembly of claim 1, wherein the tool string is carried by a tubing string.

7. The tool positioning assembly of claim 1, wherein the tool string is carried by coiled tubing.

8. The tool positioning assembly of claim 1, further comprising a pressure isolation means in the fluid passageway for preventing premature fluid communication between the tubing and the downhole tool.

9. The tool positioning assembly of claim 8, wherein the pressure isolation means comprises a rupture disk, a ball drop actuator, or a flow rate actuator.

10. The tool positioning assembly of claim 1, wherein the communication unit comprises:

a fluid chamber;

a fluid communication path between the fluid chamber and the fluid passageway;

a first valve positioned within the fluid communication path between the fluid chamber and fluid passageway;

a port for providing fluid communication between the fluid passageway and an exterior of the housing; and a second valve for restricting fluid flow through the port positioned therein.

11. The tool positioning assembly of claim 10, wherein the first valve is an electromagnetic valve.

12. The tool positioning assembly of claim 1, further comprising a pressure isolation means for preventing fluid communication between the coiled tubing and a downhole tool carried by the tool positioning assembly.

13. A tool positioning assembly for positioning a downhole tool connected to a tool string, the tool positioning assembly being carried by coiled tubing and comprising:

a housing having upper and lower ends adapted for connection to a tool string;

a fluid passageway for providing fluid communication through the housing;

a casing collar locator positioned within the housing;

a radiation detection unit positioned within the housing for measuring radiation in the downhole environment and for generating a signal corresponding to the measured radiation;

a mud pulser communication unit positioned within the housing;

a control unit positioned within the housing for receiving signals from the casing collar locator and the radiation detection unit and for controlling the communication unit;

pressure isolation means for preventing fluid communication between the coiled tubing and the downhole tool; and a power source for providing power to the casing collar locator, the radiation detection unit, the control unit and the communication unit.

14. The tool positioning assembly of claim 13, wherein the radiation detection unit comprises a gamma ray detector or a neutron detector.

15. The tool positioning assembly of claim 13, wherein the mud pulser communication unit comprises:

a fluid chamber;

a fluid communication path between the fluid chamber and the fluid passageway;

a first valve positioned within the fluid communication path between the fluid chamber and fluid passageway;

a port for providing fluid communication between the fluid passageway and an exterior of the housing; and a second valve for restricting fluid flow through the port positioned therein.

16. The tool positioning assembly of claim 15, wherein the first valve positioned is an electromagnetic valve.

17. The tool positioning assembly of claim 13, wherein the casing collar locator comprises:

an electromagnetic coil and magnet for electromagnetically sensing a casing collar; and an electric circuit for generating a signal when said coil electromagnetically senses a casing collar.

18. The tool positioning assembly of claim 13, wherein the pressure isolation means comprises a rupture disk, a ball drop actuator, or a flow rate actuator.

19. A method for positioning a downhole tool within a wellbore, comprising the steps of:

drilling the wellbore;

generating a wellbore log including at least one measurement of downhole formation characteristics;

connecting a tool string to a tubing, the tool string comprising a tool positioning assembly and the downhole tool;

moving the tubing with the tool string through the wellbore;

flowing fluid through the tubing while moving the tubing and the tool string through the wellbore;

continuously monitoring the pressure of the fluid flowing through the tubing with a fluid pressure sensor;

determining the concentration of radiation emissions within the wellbore;

transmitting data corresponding to the concentration of radiation emissions to the fluid pressure sensor by varying the fluid pressure of the flowing fluid;

determining the depth of the downhole tool by correlating the relative strength of radiation to the wellbore log; and adjusting the position of the downhole tool by raising or lowering the tubing.

20. The method of claim 19, further comprising the step of activating the downhole tool.

21. The method of claim 19, wherein the step of determining the concentration of radiation emission measures gamma radiation, neutron radiation, or both.

22. The method of claim 19, wherein the wellbore log measures formation characteristics comprising resistivity, neutron emissions, acoustic characteristic, spontaneous potential, or gamma ray emissions.

23. The method of claim 19, further comprising the steps of:

lowering the tubing and tool string after correlating the relative strength of the radiation to the wellbore log; and raising the tubing and tool string to a preferred location prior to activating the downhole tool.

24. The method of claim 19, wherein the step of transmitting data takes place in real time.

25. The method of claim 19, wherein the wellbore penetrates at least one zone of interest and further comprising the step of initially lowering the tubing carrying the tool string into the wellbore to a depth greater than the depth of the zone of interest.

26. The method of claim 19, further comprising the step of positioning a production string within the wellbore and lowering the tubing and the tool string through the production string.

27. The method of claim 19, further comprising the steps of:

generating a casing collar profile prior to lowering the tubing and tool string into the borehole;

after lowering the tubing and tool string into the borehole, detecting casing collars in the wellbore;

transmitting casing collar locations to the surface; and using the casing collar locations in the step of determining the depth of the downhole tool.

28. The method of claim 19, wherein the tubing is coiled tubing.

29. A method for positioning and activating a downhole tool within a wellbore, comprising the steps of:

drilling the wellbore;

generating a wellbore log, the wellbore log including at least one measurement of downhole formation characteristics;

connecting to coiled tubing a tool string comprising the downhole tool and a tool positioning assembly;

injecting the coiled tubing carrying the tool string into the wellbore;

flowing fluid through the coiled tubing while moving the coiled tubing and the tool string through the wellbore;

continuously monitoring the pressure of the flowing fluid with a fluid pressure sensor;

determining the concentration of radiation emissions within the wellbore;

transmitting radiation data to the fluid pressure sensor by varying the fluid pressure of the flowing fluid;

transmitting data corresponding to the relative strength of radiation to the surface;

determining the location of the downhole tool by correlating the relative strength of radiation to the wellbore log;

adjusting the position of the downhole tool by raising or lowering the coiled tubing; and activating the downhole tool.

30. The method of claim 29, further comprising the steps of:

lowering the coiled tubing and tool string after correlating the relative strength of the radiation to the wellbore log; and raising the coiled tubing and tool string to a preferred location prior to activating the downhole tool.

31. The method of claim 29, wherein the step of transmitting data takes place in real time.

32. The method of claim 29, wherein the wellbore penetrates at least one zone of interest and further comprising the step of initially injecting the coiled tubing carrying the tool string into the wellbore to a depth greater than the zone of interest.

33. The method of claim 29, further comprising the step of positioning a production string within the wellbore and injecting the coiled tubing carrying the tool string through the production string.

34. The method of claim 29, wherein the step of determining the concentration of radiation emission measures gamma radiation, neutron radiation, or both.

35. The method of claim 29, wherein the wellbore log measures formation characteristics comprising resistivity, neutron emissions, acoustic characteristic, spontaneous potential, or gamma ray emissions.

36. The method of claim 29, further comprising the steps of:

generating a casing collar profile prior to lowering the tubing and tool string into the borehole;

after lowering the tubing and tool string into the borehole, detecting casing collars in the wellbore;

transmitting casing collar locations to the surface; and using the casing collar locations in the step of determining the depth of the downhole tool.

37. A method for positioning and activating a downhole tool within a wellbore, comprising the steps of:

drilling the wellbore;

providing a fluid pressure sensor;

generating a wellbore log including at least one measurement of downhole formation characteristics;

connecting a tool string to a tubing, the tool string comprising a tool positioning assembly and the downhole tool;

lowering the tubing with the tool string into the wellbore;

flowing fluid through the tubing while moving the tubing and the tool positioning assembly through the wellbore;

determining the concentration of radiation emissions within the wellbore;

continuously monitoring the pressure of the fluid flowing through the tubing with the fluid pressure sensor;

transmitting data corresponding to the concentration of radiation emissions to the fluid pressure sensor by varying the fluid pressure of the flowing fluid;

determining the location of the downhole tool by correlating the relative strength of radiation to the wellbore log; and adjusting the position of the downhole tool by raising or lowering the tubing; and activating the downhole tool.

38. The method of claim 37, wherein the step of determining the concentration of radiation emission measures gamma radiation, neutron radiation, or both.

39. The method of claim 37, wherein the wellbore log measures formation characteristics comprising resistivity, neutron emissions, acoustic characteristic, spontaneous potential, or gamma ray emissions.

40. The method of claim 37, further comprising the steps of:

lowering the tubing and tool string after correlating the relative strength of the radiation to the wellbore log; and raising the tubing and tool string to a preferred location prior to activating the downhole tool.

41. The method of claim 37, wherein the step of transmitting data takes place in real time.

42. The method of claim 37, wherein the wellbore penetrates at least one zone of interest and further comprising the step of injecting the tubing carrying the tool string into the wellbore to a depth greater than the zone of interest prior determining the concentration of radiation emissions within the wellbore.

43. The method of claim 37, further comprising the step of positioning a production string within the wellbore and lowering the tubing and the tool string through the production string.

44. The method of claim 37, further comprising the steps of:

generating a casing collar profile prior to lowering the tubing and tool string into the borehole;

after lowering the tubing and tool string into the borehole, detecting casing collars in the wellbore;

transmitting casing collar locations to the surface; and using the casing collar locations in the step of determining the depth of the downhole tool.

45. The method of claim 37, wherein the tubing is coiled tubing.

46. A method for positioning and activating a downhole tool within a wellbore, comprising the steps of:

drilling a wellbore penetrating at least one subterranean zone of interest;

generating a wellbore log and a casing collar profile, the wellbore log including at least a measurement of downhole gamma ray concentrations;

connecting to coiled tubing a tool string comprising at least one downhole tool and a tool positioning assembly, the tool positioning assembly comprising:

a housing having upper and lower ends adapted for connection as part of a tool string;

a fluid passageway for providing fluid communication through the housing;

a radiation detection unit positioned within the housing for measuring radiation in the downhole environment and for generating a signal corresponding to the measured radiation;

a casing collar locator positioned within the housing;

a mud pulser communication unit positioned within the housing;

a control unit positioned within the housing for receiving signals from the casing collar locator and the radiation detection unit and for controlling the communication unit; and a power source for providing power to the casing collar locator, the radiation detection unit, the control unit and the communication unit;

moving the coiled tubing and tool string through the wellbore;

activating the radiation detection unit and monitoring the concentration of radiation emissions within the wellbore;

activating the casing collar locator;

transmitting data corresponding to the concentration of radiation emissions and casing collar locations to the surface;

determining the location of the downhole tool by correlating the relative strength of radiation and the data obtained from casing collar locator to the wellbore log and the casing collar profile;

subsequently lowering the coiled tubing and tool string to a point lower than the desired point for activating the downhole tool;

raising the coiled tubing and tool string while continuing to monitor radiation emissions until the relative strength of the radiation detected by the radiation detection unit reflects the desired depth for activating the downhole tool; and activating the downhole tool.

47. The method of claim 46, further comprising the steps of:

flowing fluid through the coiled tubing while moving the coiled tubing carrying the tool string through the wellbore;

continuously monitoring the pressure of the flowing fluid by means of the fluid pressure sensor; and transmitting radiation data and casing collar locations to the fluid pressure sensor by varying the fluid pressure of the flowing fluid.

48. The method of claim 46, wherein the step of transmitting data takes place in real time.

49. The method of claim 46, wherein the tool string is injected to a depth greater than the zone of interest.

50. The method of claim 46, further comprising the step of positioning a production string within the wellbore and injecting the coiled tubing carrying the tool positioning assembly through the production string.

51. The method of claim 46, wherein the step of monitoring radiation emissions measures gamma radiation, neutron radiation or both.

52. The method of claim 46, wherein the wellbore log measures formation characteristics comprising resistivity, neutron emissions, acoustic characteristic, spontaneous potential, or gamma ray emissions.

* * * * *